US005472178A

United States Patent [19]

Paar et al.

[11] Patent Number: 5,472,178

[45] Date of Patent: Dec. 5, 1995

[54] DEVICE FOR CONTROLLING THE STOPPER OF A METALLURGICAL VESSEL

[75] Inventors: Leonhard Paar, Leoben; Franz Hammerer, Trofaiach; Gerhard Grabner, Leoben; Walter Engleitner; Werner Brandl, both of Trofaiach; Ernst Weninger; Johann Auer, both of Leoben; Walter Schiman, Trofaiach, all of Austria

[73] Assignee: Voest-Alpine Industrieanlagenbau GmbH, Linz, Austria

[21] Appl. No.: 256,514

[22] PCT Filed: Nov. 10, 1993

[86] PCT No.: PCT/AT93/00174

§ 371 Date: Jul. 11, 1994

§ 102(e) Date: Jul. 11, 1994

[87] PCT Pub. No.: WO94/11137

PCT Pub. Date: May 26, 1994

[30] Foreign Application Priority Data

Nov. 11, 1992 [AT] Austria ..... 2228/92

[51] Int. Cl.[6] ..... B22D 41/20

[52] U.S. Cl. ..... 266/236; 222/602

[58] Field of Search ..... 222/602, 594, 222/597, 590, 591; 266/236

[56] References Cited

U.S. PATENT DOCUMENTS

| | | | |
|---|---|---|---|
| 2,087,563 | 7/1937 | Wallace | 266/236 |
| 2,753,606 | 7/1956 | Fogt | 222/602 |
| 4,508,247 | 4/1985 | Mills et al. | 222/602 |
| 5,118,084 | 6/1992 | Paulus et al. | 266/236 |

FOREIGN PATENT DOCUMENTS

| | | | |
|---|---|---|---|
| 0439681 | 8/1991 | European Pat. Off. . | |
| 2116510 | 7/1972 | France . | |
| 825586 | 12/1951 | Germany . | |
| 5200504 | 8/1993 | Japan | 222/602 |
| 1247238 | 9/1971 | United Kingdom . | |

*Primary Examiner*—Scott Kastler
*Attorney, Agent, or Firm*—Cushman Darby & Cushman

[57] ABSTRACT

In a device for controlling a plug (5) of a metallurgical vessel (1), in particular a distributing launder of a continuous casting installation, with a plug (5), which can be raised and lowered and which is supported in a support frame which is movable relative to the metallurgical vessel (1), the support frame for the plug (5), which can be raised and lowered, is supported outside of the metallurgical vessel (1) displaceable in a direction crosswise to the lifting direction of the plug (5) and can be releasably locked together with the metallurgical vessel. By means of this a simple separation of the plug mechanism (9) and the metallurgical vessel (1) is possible without operational elaboration and an exchange of the metallurgical vessel (1), for example, is made possible without having to dismantle the entire plug mechanism (5, 9).

6 Claims, 4 Drawing Sheets

DEVICE FOR CONTROLLING THE STOPPER OF A METALLURGICAL VESSEL

BACKGROUND OF THE INVENTION

1. Field of the Invention

The invention relates to a device for controlling a plug of a metallurgical vessel, in particular a distributing launder of a continuous casting installation having a plug which can be raised and lowered and is supported in a support frame which is movable in respect to the metallurgical vessel and can be locked together with the metallurgical vessel.

2. Description of the Prior Art

A device of the above mentioned type is known from EP-A1-439 681, for example. In this known device the plug is connected to a cross arm disposed above the distributing launder or the metallurgical vessel for the controllable displacement of a plug. This cross arm is connected in turn with a support bar which can be moved up and down on a vertical guide, wherein the vertical guide of the support bar is embodied as a roller guide. The known device is fixed on the exterior of the distributing launder so that its mobility in relation to the metallurgical vessel or the distributing launder is only provided within the guide at the outer edge of the distributing launder or the metallurgical vessel.

Conventional devices are known from a number of further references, particularly EP-A2-435 540 as well as DE-A 2 021 211, wherein the plug mechanism for regulating the outflowing liquid metal is individually fastened to the distributing launder. The plug mechanism remains in the installed position when the tundish is changed.

This fixed and rigid connection between the plug mechanism and the distributing launder results in that as a rule the control or the plug rods are not dismantled, even when the brick lining of the distributing launder is renewed, since the fixed attachment at the distributing launder requires a too extensive and complicated dismantling process.

The plug rod which as a rule is equipped with a metal element on one end for fastening on a support bracket and with a conduit used for cooling, is knocked off after a predetermined number of launder drainings because, on the one hand, it is used up and, on the other, a removal without destroying it would entail a relatively large effort. Furthermore, pivoting mechanisms have been proposed in this connection which, however, also have not been accepted.

SUMMARY OF THE INVENTION

It is now the object of the invention to provide a device of the above mentioned type by means of which a separation of the plug mechanism from the metallurgical vessel or the distributing launder of a continuous casting installation is possible without a great operational outlay and which makes it possible to perform a tundish change, for example, without having to dismantle the entire plug mechanism. In connection with the brick lining work in particular, the aim of the device in accordance with the invention is to make possible such brick lining operations without impairment by the plug mechanism. To attain this object the embodiment in accordance with the invention is essentially characterized in that the support frame for the plug, which can be raised and lowered, is supported movable crosswise to the lifting direction of the plug outside of the metallurgical vessel. Because a separately displaceable support frame for the plug, which can be raised and lowered, is provided apart from the metallurgical vessel, particularly the distributing launder, it is made possible to separate the frame from the tundish and in this way to lift the distributing launder away without hindrance, for example by means of a hoist. The individual plug guides or the plug mechanism can be respectively kept in a displaced position which does not hamper the operation and is again available immediately at the end of the exchange operation with preadjusted distances for the individual plugs. This is of particular importance, especially with an embodiment with a plurality of plugs, because by means of this the maintenance effort and the amount of time necessary for an exchange of the distributing launder can be considerably reduced. Because now the support frame can be removably locked together with the metallurgical vessel, on the one hand a possibility is created to unlock the frame from the metallurgical vessel or the tundish for a tundish change and, on the other, to assure an exact and relatively tolerance-free operation in the working position.

The embodiment in accordance with the invention is advantageously such, that the support frame is supported on or suspended from a portal frame which can be moved outside of the metallurgical vessel. Such a portal frame can receive one or a plurality of plugs, which can be raised or lowered, in order to make possible in this way the rapid installation of one or a plurality of plug guides on a distributing launder. Basically, the portal frame can here be mounted either stationary on the casting platform or on the tundish car and moving along with it, wherein it is of course necessary that the metallurgical vessel or the distributing launder be movably or displaceably seated in an appropriate manner in case of a stationary disposition of the portal frame.

In a particularly advantageous manner the embodiment in accordance with the invention is further developed in such a way that the plug, which can be raised or lowered, or its support frame, are guided displaceable crosswise to the displacement direction of the portal frame. With such an embodiment it is possible to achieve great flexibility and displaceability when the rail of the portal car has been laid in a stationary manner. If the portal frame can be moved in the manner of a car on a rail, it is possible to provide the desired adjustment relative to the metallurgical vessel or the distributing launder in a simple manner by displacement of the support frame relative to the portal frame. In the process the support frame is advantageously guided so it can be raised and lowered.

To assure an operation which is free of play and operationally dependable in the working position in order to reduce tolerances, the releasable locking in relation to the metallurgical vessel is embodied to be such that the support frame is designed with a coupling member, particularly a claw, which in the working position of the plug cooperates with a complementary embodied coupling member on the exterior of the metallurgical vessel. Such a claw requires only little structural effort and the locking member which is to be disposed in this way on the distributing launder or the metallurgical vessel for engagement of the claw does not present any hindrance whatsoever during brick-lining operations. On the contrary, such a counter-locking device can be easily used for transporting the distributing launder or the metallurgical vessel for the purpose of performing brick-lining work.

The embodiment is made in a particularly simple manner such, that a plurality of support frames, in particular three support frames, for plugs which can be raised and lowered are supported on the movable portal frame, wherein the structural outlay is kept relatively low by means of the common portal frame.

In a particularly simple manner the support frames here can be raised or lowered relative to the portal frame by a common drive mechanism, particularly a chain drive.

BRIEF DESCRIPTION OF THE DRAWINGS

The invention will be described in detail below by way of exemplary embodiments schematically represented in the drawings.

DESCRIPTION OF THE PREFERRED EMBODIMENTS

Figure 2:
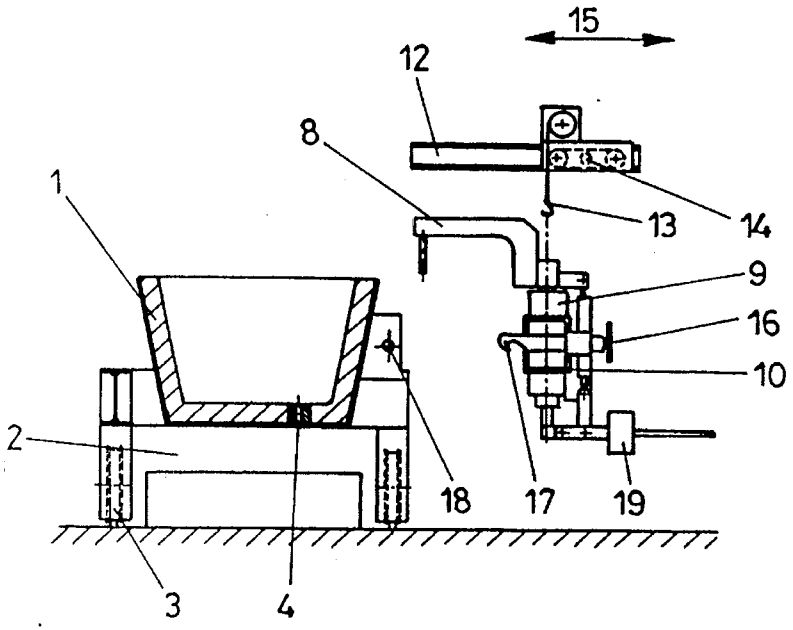
FIG. 2 shows the embodiment in accordance with FIG. 1 in a representation similar to FIG. 1 in a rest position, wherein a manipulation of the metallurgical vessel or the distributing launder is possible.
Figure 1:
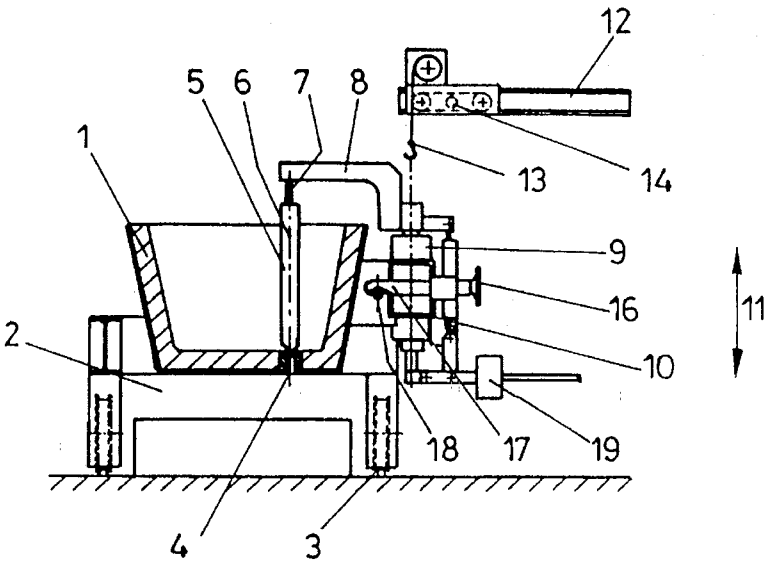
FIG. 1 shows a plan view of a first embodiment of a device of the invention for controlling a plug of a metallurgical vessel in the operational or casting position.

A metallurgical vessel, for example a distributing launder, which is seated on a casting platform 2, is identified by 1 in FIGS. 1 and 2. In this connection the casting platform 2 can be movable, as schematically indicated by wheels 3. The distributing launder has pouring spouts 4 at regular intervals which are closed in the casting position shown in FIG. 1 by a plug 5. In a known manner the plug or the plug rod 5 has a conduit extending in the longitudinal direction for cooling, as schematically indicated by 6, and can be fixed on a support bracket 8 via a metal element 7. This support bracket 8 is a part of a plug guide, generally indicated by 9, which is seated in a support frame indicated by 10. The plug guide 9 with the support bracket 8 is movable in a manner known per se for an up-and-down movement of the plug rod 5 in the direction of the two-headed arrow 11.

As can be seen in FIGS. 1 and 2, the support frame 10 for the plug or the plug guide 9 is seated by means of an appropriate holder 13 on a guide 12, wherein on the one hand raising and lowering of the entire support frame 10 also in the direction of the two-headed arrow 11 can take place by means of an electro-mechanical hoist 14, for example, and additionally the entire support or the hoist 14 is movable along the guide 12 in the direction of the two-headed arrow 15. In this way it is possible, as can be seen in FIG. 2 in particular, to bring the entire plug control as well as the support frame 10 for the plug into a position in which the metallurgical vessel or the distributing launder 1 can easily be lifted off its position on the casting platform in order to perform brick-lining work, for example.

Thus, in contrast to known embodiments wherein the plug control was fixed directly on the distributing launder, with the illustrated embodiment it is only necessary to remove the launder, so that work to be performed on the launder or on the metallurgical vessel can be executed without hindrance and without having to take a possible plug guidance or plug mechanism into consideration.

Thus, with the embodiment illustrated in FIGS. 1 and 2, the support frame 10 for the plug guide 9 can be moved in a direction which is essentially normal to the direction of movement of the plug as well as the plug mechanism, wherein the adjustment in the normal direction indicated by the two-headed arrow 15 is performed in the direction of the longitudinal extension of the distributing launder 1 by means of the adjustment of the distributing launder 1 on the casting platform.

In order to assure the correct positioning of the plug mechanism relative to the metallurgical vessel 1 during casting operations, the support frame is embodied with a clamping device generally indicated by 16, wherein the clamping device includes a claw 17 which cooperates with a complementary embodied coupling member 18 on the exterior of the metallurgical vessel in order to assure a correct and stable positioning of the plug guide relative to the metallurgical vessel during operation. It can be clearly seen that this mutual coupling can be easily undone.

A manual lever 19 is additionally indicated which allows the handy actuation of the bracket 8 of the plug guide.

Figure 3:
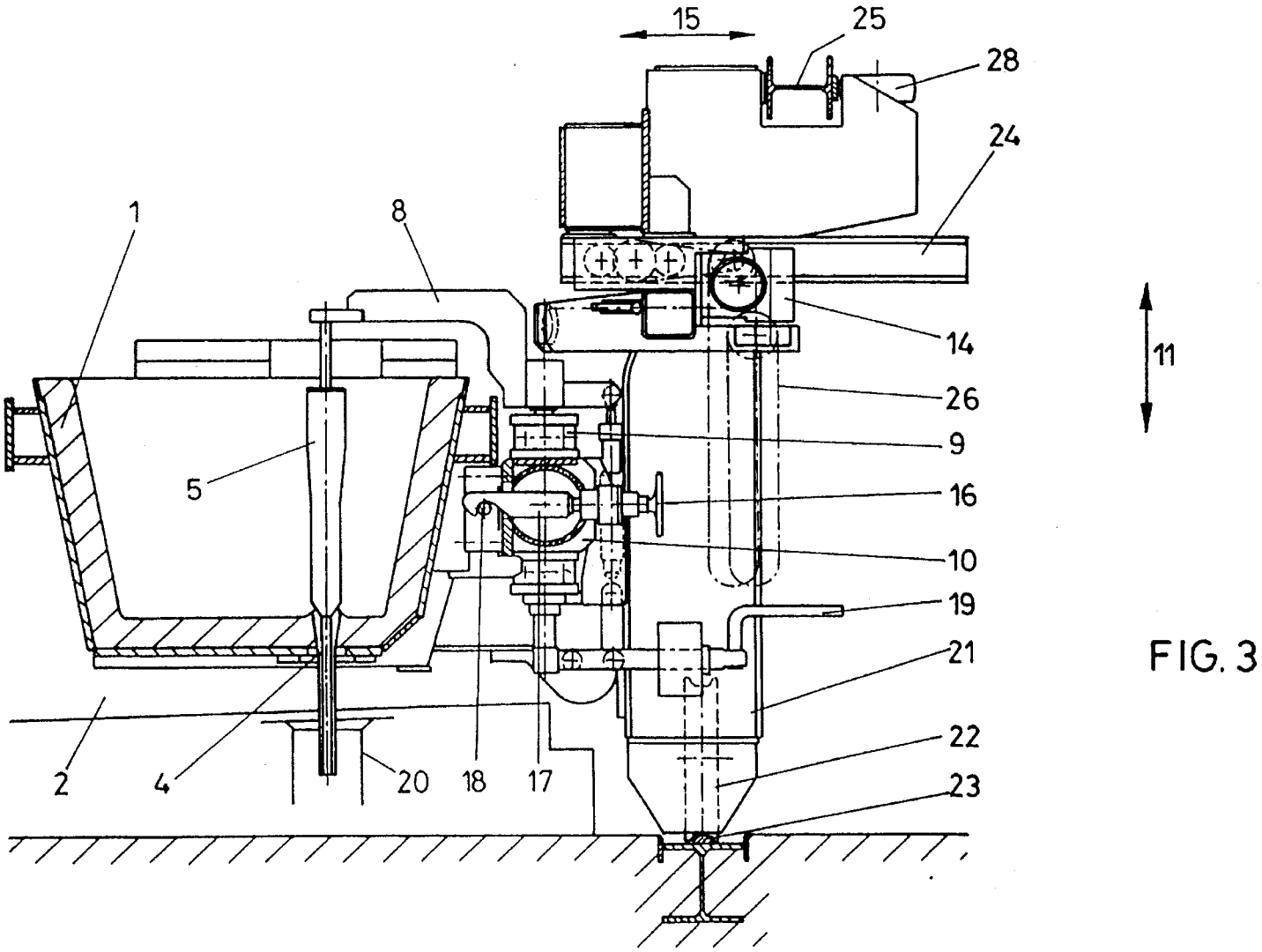
FIG. 3 shows a variant embodiment of a device of the invention for controlling a plug of a metallurgical vessel on an enlarged scale in a representation analogous to FIG. 1, wherein the device comprises a movable portal frame.
Figure 4:
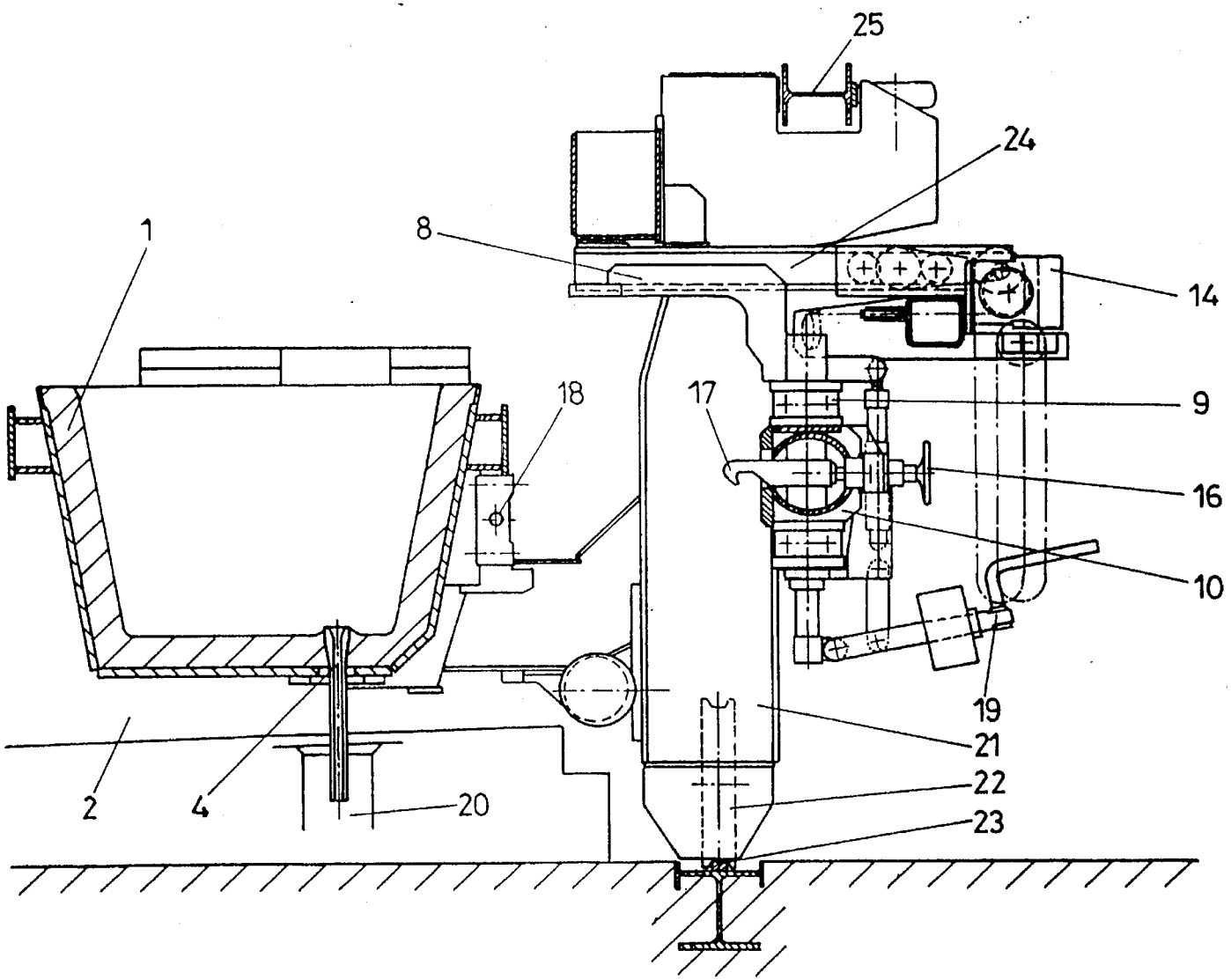
FIG. 4 shows the rest position of the device in accordance with FIG. 3 in a representation analogous to FIG. 2.
Figure 5:
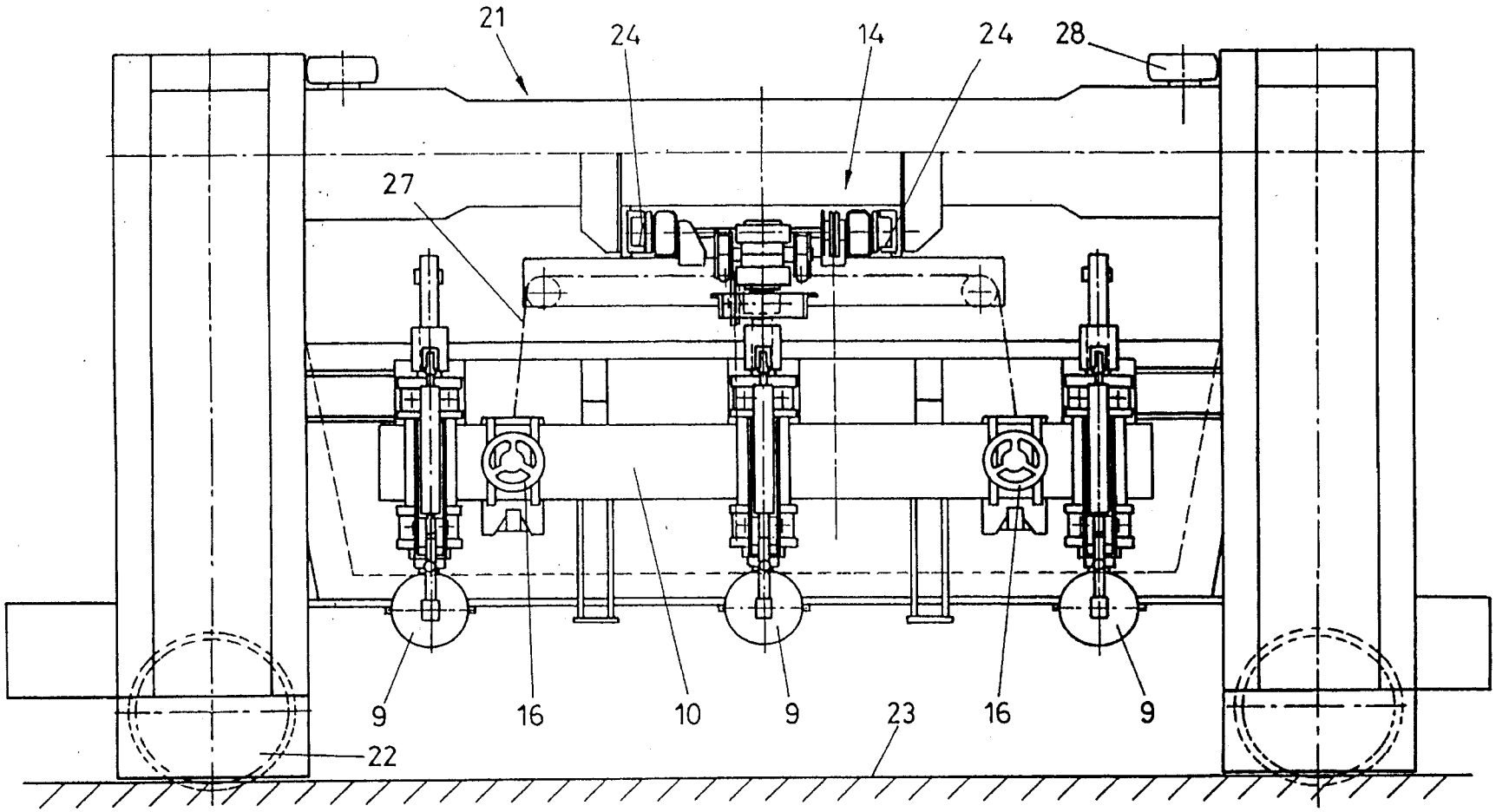
FIG. 5 shows a rear view of the embodiment in accordance with FIGS. 3 and 4.

In the variant embodiment shown in FIGS. 3 to 5, the reference numerals of the previous embodiments have been retained for like components. In this case a metallurgical vessel or a distributing launder 1 is essentially stationary disposed on a casting platform, again indicated by 2, and in FIG. 3 the casting or working position is again shown, while in FIG. 4 the position of the plug guide or its support frame is shown, in which a simple removal of the distributing launder 1 is possible without hindrance. The opening 4 near the distributing launder 1 terminates in a mold 20.

In this embodiment the support frame 10 for the plug guide 9 or for the plug 5 connected therewith via the support bracket 8 is seated in a portal car 21, wherein this portal car 21 can be moved via schematically indicated wheels 22 on a rail 23 and thus is essentially displaceable along the long extension of the distributing launder 1. The portal car 21 has a guide 24 corresponding to the guide 12 of the previous embodiment, along which the support frame 10 can be moved, again by means of a hoist or a support 14, in the direction of the two-headed arrow 15 crosswise to the direction of movement, indicated by 11, of the plug or the plug guide. In the operating position represented in FIG. 3, the support frame 10 is solidly fixed via the clamping device generally indicated by 16 with the claw 17 on a corresponding coupling element 18 on the exterior of the distributing launder 1.

Furthermore, a guide 25 indicated in the upper region of the portal car 21 is shown. Control chains for the movement of the support frame 10 in the portal frame as well as raising and lowering of the plug guide are indicated by 16.

It can be seen from the rear view in accordance with FIG. 5, that three plug guides 9 seated in a common support frame 10 are disposed in the portal car 21, wherein the support frame 10 can be raised and lowered by a schematically indicated raising and lowering drive mechanism 27. In addition, the guides 24 on the portal car can be seen, wherein the seating or support on these is again generally indicated by 14. In this way it is possible to position a plurality of plug guides exactly relative to each other in the portal car 21, so that with the appropriate positioning of the portal car by means of its movement along the rail 21 in respect to a distributing vessel a plurality of plug guides are exactly positioned by the simultaneous lowering of the support frame.

Guide rollers are indicated by 28, which cooperate with the guide 25 in the region of the top of the portal frame.

Thus, with this embodiment a movement of the plug guide 9 or of a plug 5 in essentially three normally right-angled positions in respect to each other is made possible, so that the exact positioning in relation to the metallurgical vessel 1 is easily possible.

We claim:

1. A device for controlling a plug of a metallurgical vessel employed in a distributing launder of a continuous casting installation, said installation including a plug which can be raised and lowered and which is supported in a support frame adapted to be selectively locked in position relative to the vessel and which, when unlocked, is movable in respect of the metallurgical vessel, said frame being supported outside of the metallurgical vessel and adapted to be raised and lowered and rectilinearly displaced crosswise to the direction of movement of the plug.

2. A device in accordance with claim 1, wherein the support frame is supported by a portal car which is displaceable.

3. A device in accordance with claim 2, wherein the support frame is guided to be displaceable crosswise to the displacement direction of the portal car.

4. A device in accordance with claim 1, 2 or 3, wherein the support frame is guided so it can be raised or lowered.

5. A device in accordance with claim 1, 2 or 3, wherein the support frame includes a coupling member which cooperates with a complementary coupling member on the exterior of the metallurgical vessel to lock the support frame to said vessel.

6. A device in accordance with claim 4, wherein the support frame can be raised and lowered relative to the portal car by means of a drive mechanism.

* * * * *